US008932240B2

(12) United States Patent
Kaiser

(10) Patent No.: US 8,932,240 B2
(45) Date of Patent: Jan. 13, 2015

(54) METHOD AND APPARATUS FOR PROVIDING A DYNAMICALLY LOADED FORCE AND/OR A STATIC PROGRESSIVE FORCE TO A JOINT OF A PATIENT

(75) Inventor: Robert T. Kaiser, St. George, UT (US)

(73) Assignee: Lantz Medical Inc., Indianapolis, IN (US)

( * ) Notice: Subject to any disclaimer, the term of this patent is extended or adjusted under 35 U.S.C. 154(b) by 335 days.

(21) Appl. No.: 13/593,786

(22) Filed: Aug. 24, 2012

(65) Prior Publication Data

US 2012/0323148 A1 Dec. 20, 2012

Related U.S. Application Data

(62) Division of application No. 12/638,003, filed on Dec. 15, 2009, now Pat. No. 8,257,283.

(60) Provisional application No. 61/138,213, filed on Dec. 17, 2008, provisional application No. 61/234,665, filed on Aug. 18, 2009.

(51) Int. Cl.
*A61H 1/02* (2006.01)

(52) U.S. Cl.
CPC ..... *A61H 1/0285* (2013.01); *A61H 2001/0203* (2013.01); *A61H 1/02* (2013.01); *A61H 2201/165* (2013.01)
USPC ..... 601/5; 601/33; 601/40; 602/16

(58) Field of Classification Search
CPC ..... A61H 1/00; A61H 1/02; A61H 1/0266; A61H 1/0274; A61H 1/0277; A61H 1/0281; A61H 1/0285; A61H 1/0288; A61H 2001/0203
USPC ..... 601/5, 29, 33, 40; 602/16, 20, 21, 23, 602/26, 27, 30
See application file for complete search history.

(56) References Cited

U.S. PATENT DOCUMENTS 5,520,625 A 5/1996 Malewicz

OTHER PUBLICATIONS

Search Notes for U.S. Appl. No. 12/638,003, patent document, Jun. 18, 20112, 5 pages, USPTO, Alexandria, Virginia.
Examiner's Amendment and Reasons for Allownace for U.S. Appl. No. 12/638,003, patent document, Jul. 11, 20112, 3 pages, USPTO, Alexandria, Virginia.

*Primary Examiner* — Laura Bouchelle
(74) *Attorney, Agent, or Firm* — D'Hue Law LLC; Cedric D'Hue

(57) ABSTRACT

A method and a continuous passive motion device for providing a dynamically loaded force and a static progressive force to a joint of a patient.

12 Claims, 5 Drawing Sheets

METHOD AND APPARATUS FOR PROVIDING A DYNAMICALLY LOADED FORCE AND/OR A STATIC PROGRESSIVE FORCE TO A JOINT OF A PATIENT

CROSS REFERENCE TO RELATED APPLICATIONS

This application is a divisional of U.S. patent application Ser. No. 12/638,003, filed Dec. 15, 2009, which claims the benefit of priority to U.S. Provisional Patent Application Ser. No. 61/138,213, filed Dec. 17, 2008, and U.S. Provisional Patent Application No. 61/234,665, filed Aug. 18, 2009, the contents of each are expressly incorporated by reference.

FIELD

The present disclosure relates to a method and corresponding apparatus for providing a dynamically loaded force and/or a static progressive force to a joint.

BACKGROUND

Continuous Passive Motion (CPM) is a post-operative therapy that moves a joint passively through a prescribed range of motion for a prescribed period of time. Some of the proven benefits of CPM include the prevention of immobilization disease, improved joint nutrition, remodeling of joint surfaces, faster Range of Motion (ROM) gain, faster resorption and/or reduction of swelling conditions, decreased need for pain medication, and greater compliance to active and/or strengthening rehabilitation programs.

Immobilization disease can cause adhesion formation, joint contractures, and degeneration of articular and/or periarticular cartilage. Improved joint nutrition is characterized by enhanced delivery of oxygen and nutrients to the joints. With remodeling of joint surfaces, Wolf's law states that healing tissue will be laid down in a pattern dictated by the stresses imposed upon the tissue. CPM imposes stress upon the entire range of motion of the joint. Wolf's law results in healing tissue laid down over the entire range of motion of the joint.

Passive motion is a common therapy modality. CPM devices are utilized to attain the benefits of CPM. An appropriate CPM device is the Vector 2 Hand & Wrist Rehabilitation System (hereinafter "Vector 2"), available at Lantz Medical, 7750 Zionsville Road, Suite 800, Indianapolis, Ind. 46268. The Vector 2 Hand & Wrist Rehabilitation System Information document discloses indications, key features and benefits, and clinical advantages of the Vector 2. The Vector 2 Hand & Wrist Rehabilitation System Information document is currently available online at http://www.lantzmedical.com/website pdfs/V2%20Product%20Info%20pdf.pdf as of Dec. 13, 2009. The Vector 2 Hand & Wrist Rehabilitation System Information document is expressly incorporated by reference. Furthermore, the Vector 2 Application Guide discloses the major parts of Vector 2 and the steps of assembly for use. The Vector 2 Application Guide is currently available online at http://www.lantzmedical.com/website_pdfs/V2%20Application%20Guide.pdf as of Dec. 13, 2009. The Vector 2 Application Guide is expressly incorporated by reference. Finally, the present disclosure refers to parts of Vector 2 as described in the Vector 2 Hand & Wrist Rehabilitation System Information document and the Vector 2 Application Guide.

As shown in FIGS. 1A-1D, CPM device 10 may be utilized as a hand CPM, a wrist CPM, rehabilitation system for tenodesis, or combined motions, especially as a combined hand and wrist CPM. As a hand and wrist rehabilitative system, CPM device 10 flexes and extends interphalangeal joints 12 (including distal and proximal interphalangeal joints) and metacarpophalangeal joints 14 of hand 16 of a patient as well as flexes and extends wrist 18. CPM device 10 provides digital range of motion (digital ROM) from approximately negative twenty-one degrees (−) 21° (as shown in FIGS. 1A and 1B) to approximately three hundred and forty degrees (340°) (as shown in FIGS. 1C and 1D) as part of comprehensive motion therapy. CPM device 10 provides wrist 18 range of motion (wrist ROM) from approximately negative ninety degrees)(−90° (as shown in FIGS. 1B and 1D) to approximately ninety degrees (90°) (as shown in FIGS. 1A and 1C) as part of comprehensive motion therapy.

CPM device 10 comprises several major parts including forearm frame 20 (coupled to support 21), hand plate 22, hand drive unit 24, wrist drive unit 25, and leaf spring caterpillars 26 (also described as dynamic wire actuators). CPM device 10 provides at least one leaf spring caterpillar 26 for each digit 28 (also described throughout as a finger and/or thumb). As shown in each of FIGS. 1A-1D, CPM device 10 is configured to align with the dorsal side of the patient's forearm 30, wrist 18, and/or hand 16 in order to assist each finger 28. As described in greater detail in U.S. Provisional Patent Application No. 61/234,665, both Vector 1 and CPM device 10 are configured to align with the lateral side of the patient's forearm 30, wrist 18, and/or hand 16 for use with each thumb 28. Each leaf spring caterpillar 26 is malleable to allow for digital range of motion (digital ROM) considerations for each digit 28. CPM device 10 also includes several straps 31 (such as forearm straps 31 and cross straps 31 with thumb guard 31) and foam pads coupled to forearm frame 20 and hand plate 22. CPM device 10 also includes a custom glove (not shown) which fits over the patient's hand 16, wrist 18, and optionally patient's forearm 30.

SUMMARY

The present disclosure includes a continuous passive motion device for use with a joint of a patient. The device comprising a first hinge housing, a second hinge housing coupled to the first hinge housing, the second hinge housing including at least one spring loading pin and a pin stop block, the second hinge housing configured to rotate about a rotational axis, the second hinge housing configured to rotate in relationship to the first hinge housing. The device also comprises a worm wheel located between the first hinge housing and the second hinge housing, the worm wheel including at least one spring loading pin. The device also comprises at least one torsion spring located either between the first hinge housing and the worm wheel or between the worm wheel and the second hinge housing, the at least one torsion spring located adjacent to the worm wheel, the spring loading pin of the worm wheel configured to engage the at least one torsion spring, the at least one torsion spring configured to engage the spring loading pin and the pin stop block of the second hinge housing.

The present disclosure includes a continuous passive motion device for use with a joint of a patient. The device comprising a forearm frame configured for support by the forearm of the patient and a wrist drive unit coupled to the forearm frame. The wrist drive unit including a first hinge housing coupled to the forearm frame, the first hinge housing defining a cavity, a rotational pin aperture, and a worm screw aperture. The wrist drive unit also including a second hinge housing coupled to the first hinge housing, the second hinge housing configured to rotate about a rotational axis, the second hinge housing configured to rotate in relationship to the first hinge housing, the second hinge housing including at least one spring loading pin and a pin stop block, the second hinge housing defining a rotational pin aperture and a bore for receiving a static lock actuator, the static lock actuator controlled by a lock actuator handle. The wrist drive unit also including a worm wheel located within the cavity of the first hinge housing, the worm wheel located between the first hinge housing and the second hinge housing, the worm wheel including at least one spring loading pin and a static lock pin, the static lock pin configured to interact with the static lock actuator as controlled by the lock actuator handle, the worm wheel defining at least one spring loading pin aperture and a rotational pin aperture. The wrist drive unit also including a worm screw positioned to engage the worm wheel, the worm screw including a gear located within the cavity, the worm screw including at least one bearing positioning the gear to engage the worm wheel, the worm screw configured to be driven manually or mechanically. The wrist drive unit also including at least one torsion spring located within the cavity of the first hinge housing, the at least one torsion spring located either between the first hinge housing and the worm wheel or between the worm wheel and the second hinge housing, the at least one torsion spring located adjacent to the worm wheel, the at least one torsion spring aligned along the rotational axis, the spring loading pin of the worm wheel configured to engage the at least one torsion spring, the at least one torsion spring configured to engage the spring loading pin and the pin stop block of the second hinge housing. The second hinge housing configured to cause flexion and extension of the joint of the patient.

The present disclosure also includes a method of providing a dynamically loaded force and a static progressive force to a joint of a patient. The method comprising the steps of providing a continuous passive motion device including a drive unit, where the drive unit includes a worm wheel including at least one spring loading pin, where the drive unit includes at least one torsion spring and a rotatable frame including at least one spring loading pin and a pin stop block. The method comprising the steps of rotating the worm wheel in a first direction, contacting the spring loading pin of the worm wheel to a first surface of the at least one torsion spring, contacting a second surface of the at least one torsion spring to the spring loading pin of the rotatable frame, using the at least one torsion spring to create a dynamically loaded force, placing the dynamically loaded force upon the spring loading pin of the rotatable frame, rotating the rotatable frame based on the dynamic loaded force, transferring the dynamically loaded force to the joint of the patient, continuing to rotate the worm wheel in the first direction, contacting a third surface of the at least one torsion spring to the pin stop block of the rotatable frame, using the pin stop block to transfer static progressive force from the worm wheel to the rotatable frame, and transferring the static progressive force to the joint of the patient.

BRIEF DESCRIPTION OF THE DRAWINGS

The above-mentioned and other features of this disclosure, and the manner of attaining them, will become more apparent and the disclosure itself will be better understood by reference to the following description of embodiments of the disclosure taken in conjunction with the accompanying drawings, wherein.

Figure 1A:
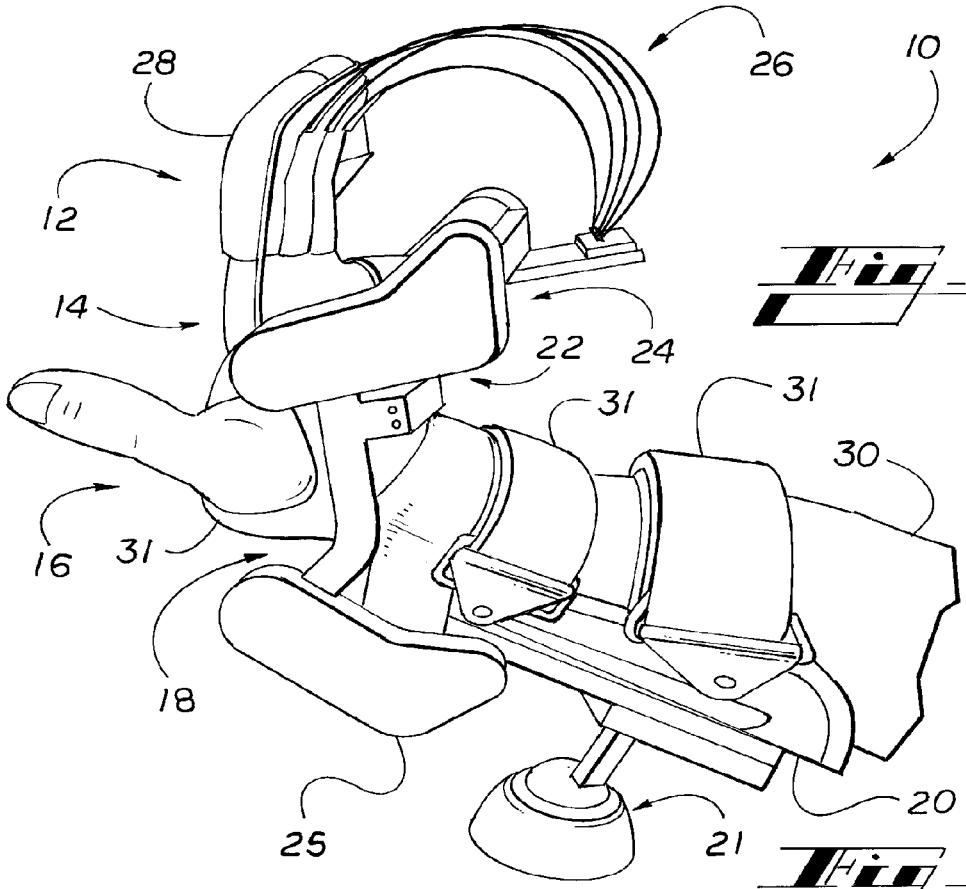
FIG. 1A is a side view of CPM device illustrating its range of motion as a hand and wrist rehabilitation system.

Corresponding reference characters indicate corresponding parts throughout the several views. Although the drawings represent embodiments of the present disclosure, the drawings are not necessarily to scale and certain features may be exaggerated in order to better illustrate and explain the present disclosure.

DETAILED DESCRIPTION OF THE EXEMPLARY EMBODIMENTS

The embodiments disclosed below are not intended to be exhaustive or limit the disclosure to the precise forms disclosed in the following detailed description. Rather, the embodiments are chosen and described so that others skilled in the art may utilize their teachings.

Figure 1B:
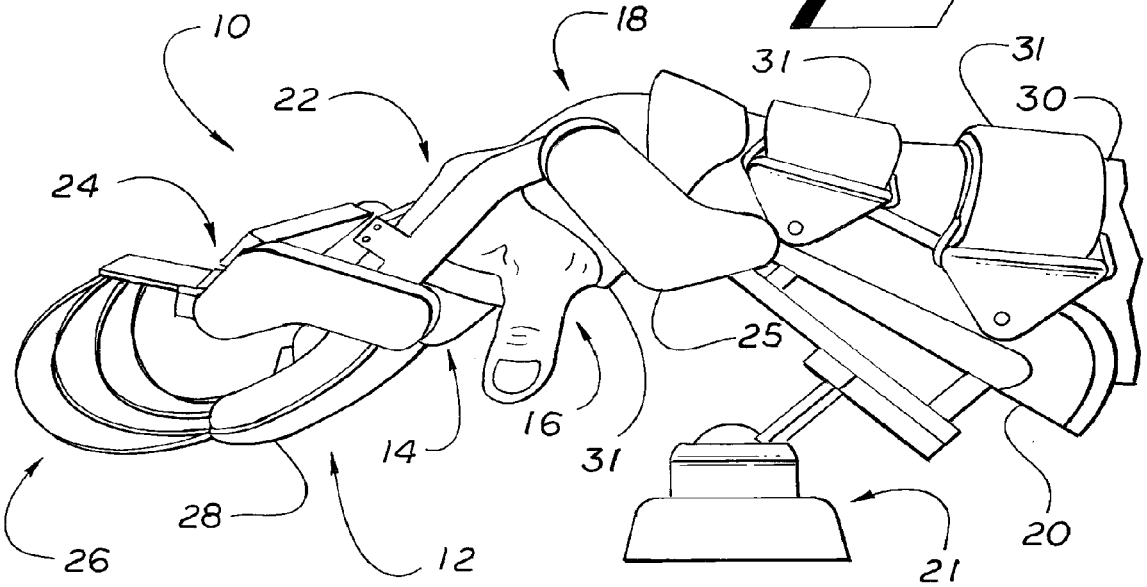
FIG. 1B is a side view of CPM device illustrating its range of motion as a hand and wrist rehabilitation system.
Figure 1C:
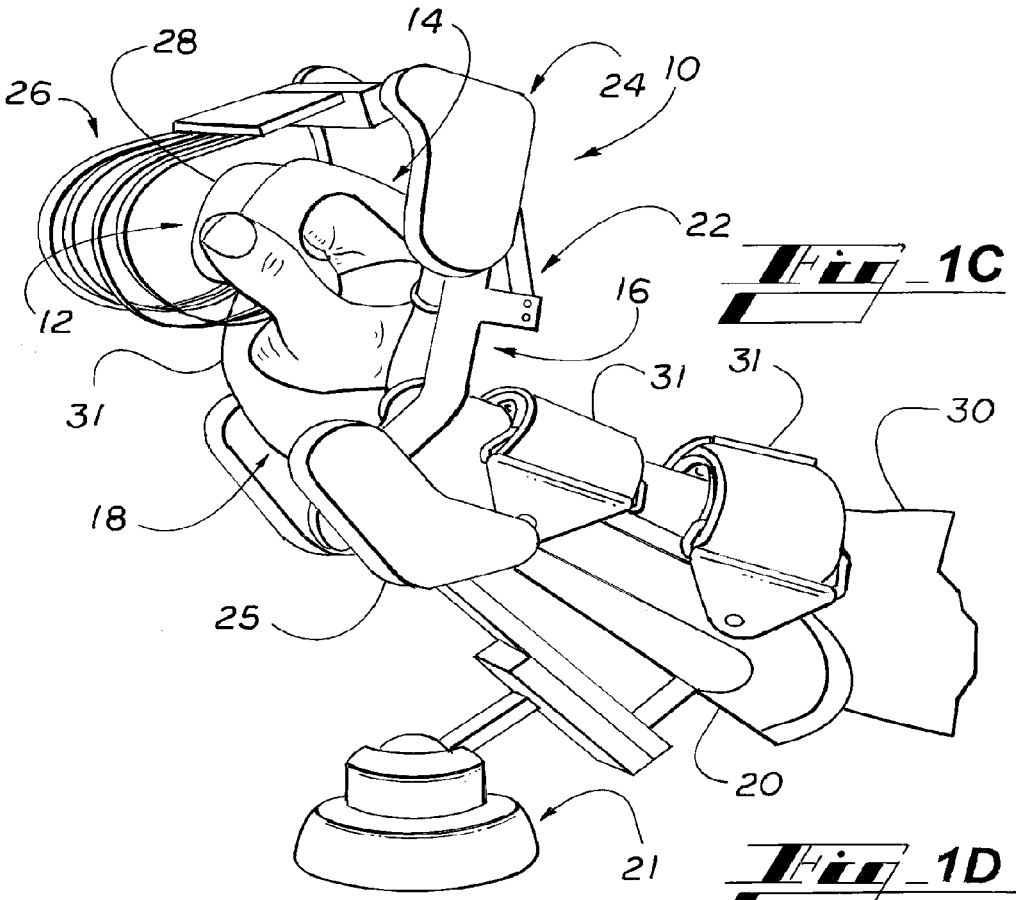
FIG. 1C is a side view of CPM device illustrating its range of motion as a hand and wrist rehabilitation system.
Figure 1D:
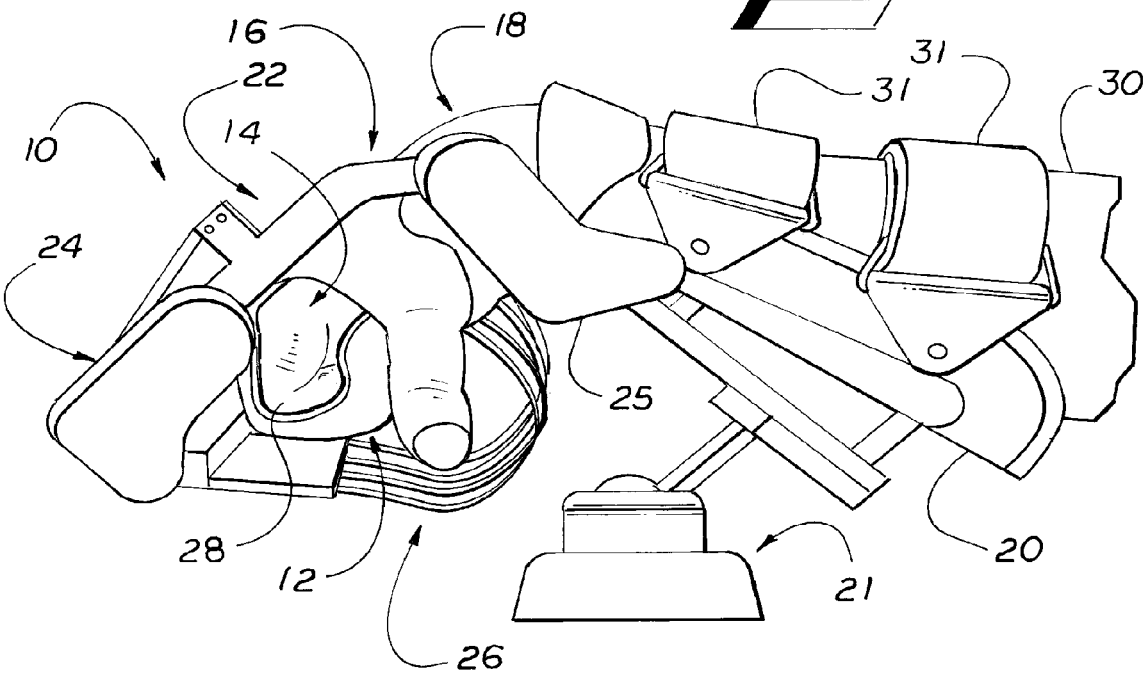
FIG. 1D is a side view of CPM device illustrating its range of motion as a hand and wrist rehabilitation system.
Figure 2:
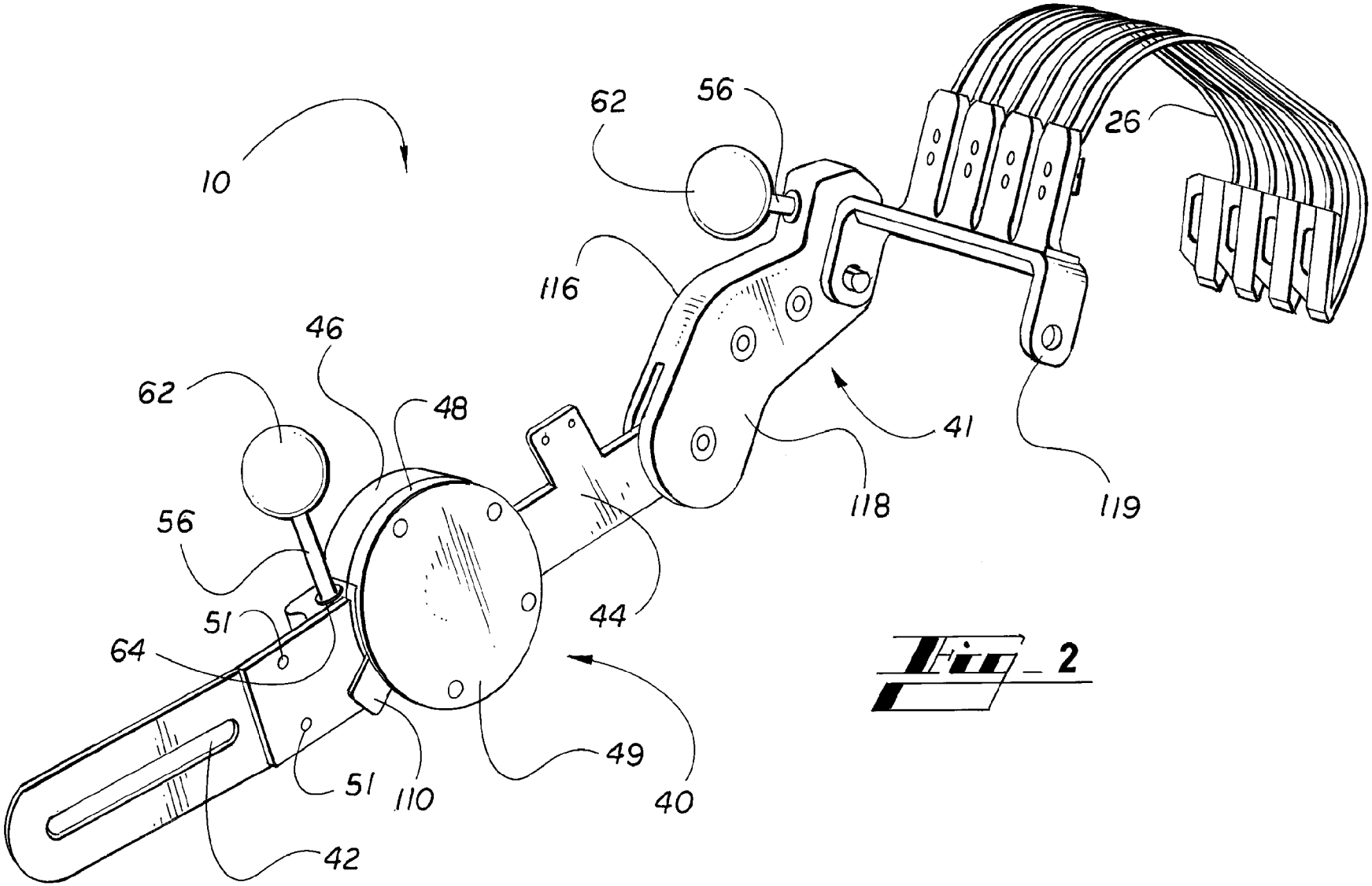
FIG. 2 is a perspective view of a portion of CPM device including the present disclosure of a wrist drive unit providing a dynamically loaded force and/or a static progressive force to a joint.

Referring to FIG. 2, a portion of CPM device 10 is shown to include wrist drive unit 40 according to the present disclosure, hand drive unit 41, and leaf spring caterpillars 26. Wrist drive unit 40 is connected to CPM device 10 in a similar fashion as wrist drive unit 25 (FIGS. 1A-1D) is connected to CPM device 10. Wrist drive unit 40 is mounted to forearm frame 20 (FIGS. 1A-1 D) either directly or indirectly by frame portion 42. First hinge housing 46 is mounted to frame portion 42 by any fastening method. In this illustrative embodiment, first hinge housing 46 is fastened to frame portion 42 by screws (not shown) and corresponding apertures 51 defined in first hinge housing 46 and frame portion 42. Wrist drive unit 40 is fastened to limb support arm 44 which is coupled to hand drive unit 41. Limb support arm 44 rotates hand drive unit 41 based on motion caused by wrist drive unit 40 as described below in greater detail.

As shown in FIG. 2, wrist drive unit 40 includes first hinge housing 46 and second hinge housing 48. Specifically, first hinge housing 46 is directly coupled to frame portion 42 which is mounted on forearm 30 (FIGS. 1A-1 D) of the patient. Second hinge housing 48 is configured to rotate in relation to first hinge housing 46 as described in greater detail below. Rotation of second hinge housing 48 in relation to first hinge housing 46 causes rotation or motion of joints of the patient. Second hinge housing 48 is directly coupled to limb support arm 44 which is coupled to other parts of CPM device 10 which are ultimately mounted to the hand 16, wrist 18, and/or digits 28 of the patient.

As illustrated in FIG. 2, wrist drive unit 40 is shown in a reduced, working configuration ready for operation. Wrist drive unit 40 also includes housing cover plate 49 used to couple limb support arm 44 to second hinge housing 48. Limb support arm 44 is directly coupled to second hinge housing 48 such that movement of second hinge housing 48 causes corresponding movement of limb support arm 44.

Limb support arm 44 couples wrist drive unit 40 to hand drive unit 41. Limb support arm 44 transfers rotation of second hinge housing 48 of wrist drive unit 40 to hand drive unit 41. Rotation of hand drive unit 41 causes flexion and extension (also referred to as hyperextension) of wrist 18 of the patient. As shown in FIGS. 1A and 1C, wrist drive unit 25 causes hand drive unit 24 to be positioned higher than wrist drive unit 25. Similarly, wrist drive unit 40 causes hand drive unit 41 to be positioned higher than wrist drive unit 40, also characterized as extension of wrist 18. As shown in FIGS. 1B and 1D, wrist drive unit 25 causes hand drive unit 24 to be positioned lower than wrist drive unit 25. Similarly, wrist drive unit 40 causes hand drive unit 41 to be positioned lower than wrist drive unit 40, also characterized as flexion of wrist 18. Wrist drive unit 40 of CPM device 10 provides wrist 18 range of motion (wrist ROM) from approximately negative ninety degrees(−90°) (alternatively described as 90° of flexion; as shown in FIGS. 1 B and 1 D) to approximately ninety degrees(90°) (alternatively described as 90° of extension or hyperextension; as shown in FIGS. 1A and 1C) as part of comprehensive motion therapy.

Figure 3:
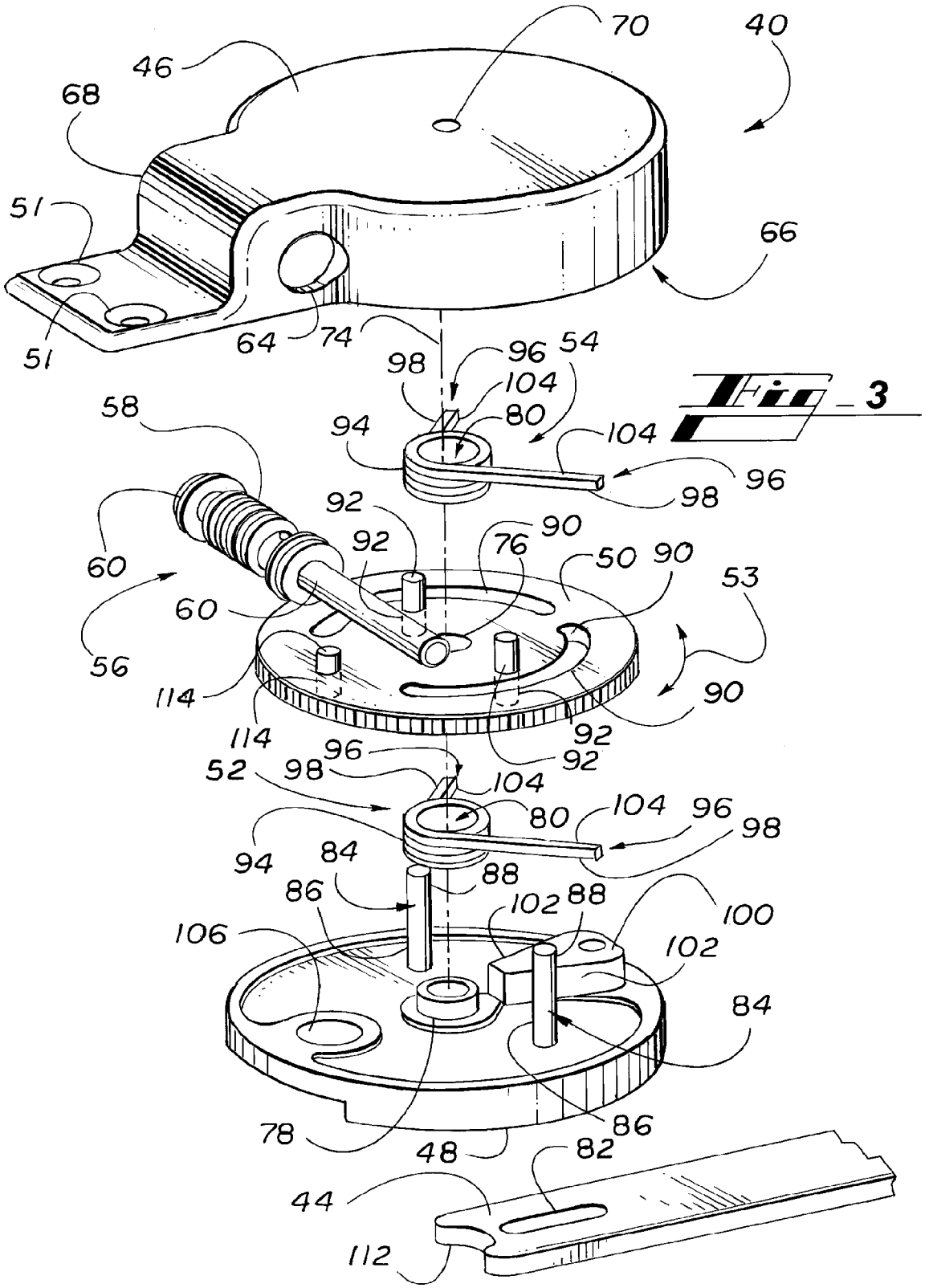
FIG. 3 is an exploded view of the drive unit of FIG. 2.

Now referring to FIG. 3, wrist drive unit 40 includes worm wheel 50, two torsion springs 52 and 54, and worm screw 56. Ninety degree(90°) torsion springs 52 and 54 are illustrated. Any degree torsion spring, such as one hundred and eighty degree (180°) torsion springs, can be used. Two torsion springs 52 and 54 are shown working in tandem. While two torsion springs 52 and 54 are illustrated, any number of torsion springs, including only one torsion spring such as first torsion spring 52, is sufficient for the present disclosure. Torsion spring 54 is alternatively referred to as second torsion spring 54.

Worm screw 56 includes gear 58 which meshes with worm wheel 50 to drive rotation of worm wheel 50. At least one bearing 60 positions gear 58 to engage worm wheel 50. As illustrated, worm screw 56 can optionally include a plurality of bearings 60 to position gear 58. Worm screw 56 can be driven manually using manually actuatable member 62, such as knob 62 (FIG. 2), or mechanically using a motor (not shown).

First hinge housing 46 also optionally defines worm screw aperture 64 for accepting gear 58 of worm screw 56. In this illustrative example, first hinge housing 46 defines cavity 66. Gear 58 of worm screw 56 can be optionally located within cavity 66 of first hinge housing 46. Shoulder 68 of first hinge housing 46 expands cavity 66 to allow space for gear 58 of worm screw 56. FIG. 2 illustrates wrist drive unit 40 in operational condition. In operational condition, two torsion springs 52 and 54, worm wheel 50, portions of worm screw 56 and portions of second hinge housing 48 are located within cavity 66.

As illustrated in FIG. 3, first hinge housing 46 defines rotational pin aperture 70 which is configured to receive rotational pin 72 (FIG. 4) along rotational axis 74. Worm wheel 50 defines rotational pin aperture 76 which is configured to receive rotational pin 72 along rotational axis 74. Second hinge housing 48 defines rotational pin aperture 78 which is configured to receive rotational pin 72 along rotational axis 74. Torsion springs 52 and 54 each define rotational pin apertures 80 as part of helix 94 of each torsion spring 52 and 54. Rotational pin apertures 80 of torsion springs 52 and 54 are configured to receive rotational pin 72 along rotational axis 74. Limb support arm 44 defines rotational pin slot 82 which is configured to receive rotational pin 72 in a plurality of fastening locations. In operation, rotational pin 72 secures first hinge housing 46, second hinge housing 48, worm wheel 50, and two torsion springs 52 and 54 along rotational axis 74. Rotational pin 72 also allows worm wheel 50 and second hinge housing 48 to rotate in relationship to first hinge housing 46.

According to the present disclosure, second hinge housing 48 rotates in relation to first hinge housing 46, causing second hinge housing 48 to transfer rotational force to the joint of the patient as part of comprehensive physical therapy. As described in greater detail below, second hinge housing 48 rotates under either dynamically loaded force and/or static progressive force, causing either the dynamically loaded force and/or static progressive force to transfer to the joint of the patient.

Second hinge housing 48 includes at least one spring loading pin 84. As illustrated, second hinge housing 48 includes two spring loading pins 84. Spring loading pin 84 of second hinge housing 48 engages at least one torsion spring 52. Two torsion springs 52 and 54 can work in conjunction with one spring loading pin 84 of second hinge housing 48. In this illustrative example, spring loading pin 84 defines first portion 86 and second portion 88. When wrist drive unit 40 is in its operational condition, the exploded view of wrist drive unit 40 as shown in FIG. 3 is reduced to the illustrative embodiment of wrist drive unit 40 as illustrated in FIG. 2. In the operational configuration, first portion 86 of spring loading pin 84 is located between worm wheel 50 and the rest of second hinge housing 48. In this configuration, second portion 88 of spring loading pin 84 is located between first hinge housing 46 and worm wheel 50. Worm wheel 50 defines at least one spring loading pin aperture 90 configured to receive second portion 88 of spring loading pin 84. As illustrated, worm wheel 50 defines two spring loading pin apertures 90. Similar to the plurality of spring loading pins 84, worm wheel 50 may define any plurality of spring loading pin apertures 90.

Worm wheel 50 is used to drive rotation of second hinge housing 48 to either cause extension or flexion of wrist 18 of the patient. In this illustrative embodiment, worm wheel 50 is configured to rotate in either direction 53 (i.e., worm wheel 50 is reversible). Worm wheel 50 includes at least one spring loading pin 92. As illustrated, worm wheel 50 includes a plurality of spring loading pins 92. Spring loading pins 92 extend laterally from both sides of worm wheel 50.

Each torsion spring 52 and 54 is a spring that works by torsion or twisting. As illustrated in FIG. 3, torsion springs 52 and 54 are helical torsion springs in the shape of a helix (coil) that is configured to twist about the axis of the helix. As shown in FIG. 3, the axis of each helix 94 of each torsion spring 52 and 54 is rotational axis 74 of wrist drive unit 40. Helical torsion springs 52 and 54 are charged by sideway forces (bending moments) applied to each end 96 of each torsion spring 52 and 54. These sideway forces cause a tighter twist to each helix 94 of each torsion spring 52 and 54. The tighter twist causes torsion springs 52 and 54 to store mechanical energy.

Spring loading pins 92 of worm wheel 50 are configured to engage outside surfaces 98 of each end 96 of torsion spring 52. Since torsion spring 52 is located between worm wheel 50 and second hinge housing 48, then first portion 86 of second hinge housing 48 engages outside surface 98 of end 96 of torsion spring 52. The combination of engagements (including spring loading pins 92 of worm wheel 50 and first portion 86) against ends 96 of torsion spring 52 is configured to cause torsion spring 52 to store mechanical energy.

Spring loading pins 92 of worm wheel 50 are configured to engage outside surfaces 98 of each end 96 of torsion spring 54. Since torsion spring 54 is located between first hinge housing 46 and worm wheel 50, then second portion 88 of second hinge housing 48 engages outside surface 98 of end 96 of torsion spring 54. The combination of engagements (including spring loading pins 92 of worm wheel 50 and second portion 88) against ends 96 of torsion spring 54 is configured to cause torsion spring 54 to store mechanical energy.

Spring loading pins 92 of worm wheel 50 transfer force from worm wheel 50 to torsion springs 52 and 54 to second hinge housing 48. The following statements illustrate steps of operation of wrist drive unit 40. Worm wheel 50 rotates in a first direction. As worm wheel 50 continues to rotate in a first direction, spring loading pins 92 of worm wheel 50 engage outside surfaces 98 of ends 96 of torsion springs 52 and 54. Torsion springs 52 and 54 may rotate around rotational axis 74. As worm wheel 50 continues to rotate in a first direction, outside surfaces 98 of ends 96 of torsion springs 52 and 54 engage spring loading pin 84 of second hinge housing 48.

As previously discussed, second hinge housing 48 is configured to rotate to cause extension and flexion of a joint (for example, wrist 18 of the patient). If no opposing force is placed on second hinge housing 48 or if the joint's resistance to rotation is less than the relaxed state of torsion springs 52 and 54, torsion springs 52 and 54 transfer the force of rotation of worm wheel 50 to second hinge housing 48. Second hinge housing 48 then transfers the corresponding force to the joint of the patient. If the joint has greater resistance than the relaxed state of torsion springs 52 and 54, torsion springs 52 and 54 are charged with storing mechanical energy and each torsion spring 52 and 54 experiences dynamic loading.

Dynamic loading is described as a load which changes based on the direction or degree of force applied during operation. As worm wheel 50 rotates in a first direction under joint resistance, torsion springs 52 and 54 are charged with storing mechanical energy under dynamic load conditions. The dynamic load is transferred from torsion springs 52 and 54 to the joint of the patient. As illustrated, two torsion springs 52 and 54 act in unison. Torsion springs 52 and 54 transfer load to the joint of the patient until wrist drive unit 40 reaches an end of range of motion.

Second hinge housing 48 includes pin stop block 100. In this illustrative embodiment, pin stop block 100 includes two outside surfaces 102. Each outside surface 102 is configured to engage inside surfaces 104 of either end 96 of torsion springs 52 and 54. As worm wheel 50 rotates in a first direction, torsion springs 52 and 54 rotate about rotational axis 74 or have ends 96 compressed as part of dynamic loading. As highlighted by torsion spring 52 in FIG. 3 and based upon the direction of rotation of worm wheel 50, either inside surface 104 of either end 96 of torsion spring 52 is configured to engage either outside surface 102 of pin stop block 100. Torsion springs 52 and 54 experience no increased compression as inside surface 104 of end 96 engages outside surface 102 of pin stop block 100.

There is a static progressive force transfer from worm wheel 50 through ends 96 of torsion spring 52 to second hinge housing 48 and ultimately to the joint of the patient. Static progressive force is described as the use of inelastic components to apply torque to a joint. When inside surface 104 of end 96 of torsion spring 52 engages outside surface 102 of pin stop block 100, each component used to transfer force from worm wheel 50 to the joint of the patient is inelastic. Static progressive force is useful to statically position the joint of the patient as close to end of range of motion as possible. Since static progressive force is not based upon dynamic loading force of torsion springs 52 and 54, static progressive force maximizes the torque of wrist drive unit 40 at the end of range of motion for the joint of the patient. As an illustrative embodiment, pin stop block 100 is configured to engage inside surfaces 104 of torsion spring 52 at approximately forty-five degrees(45°) and at approximately negative forty-five degrees(−45°) of range of motion. Forty-five degrees is illustrative only. There is no limitation placed upon the degree of range of motion. Several factors, such as a change in location for spring loading pin 84 and 92, limited space for pins 84 and 92, and travel slots for torsion springs 52 and 54, affect the range of motion of pin stop block 100. In this illustrative embodiment, the previously described static progressive force pathway does not utilize helix 94 of torsion spring 52.

At the end of range of motion for wrist drive unit 40, torsion springs 52 and 54 are still charged with dynamic loaded force. As a continuation of this illustrative embodiment, when worm wheel 50 is no longer rotated in the first direction or if worm wheel 50 is rotated in second direction 53 opposite first direction 53, inside surface 104 of end 96 of torsion spring 52 no longer engages outside surface 102 of pin stop block 100 and the previously described static progressive force pathway is no longer utilized. Torsion springs 52 and 54 relieve their charged mechanical energy as decreasing dynamic load until torsion springs 52 and 54 resume a relaxed state. If worm wheel 50 is rotated in second direction 53 and passes through zero degree point of the range of motion of wrist drive unit 40, the operation of wrist drive unit 40 repeats in second direction 53 as previously described for first direction 53.

Figure 4:
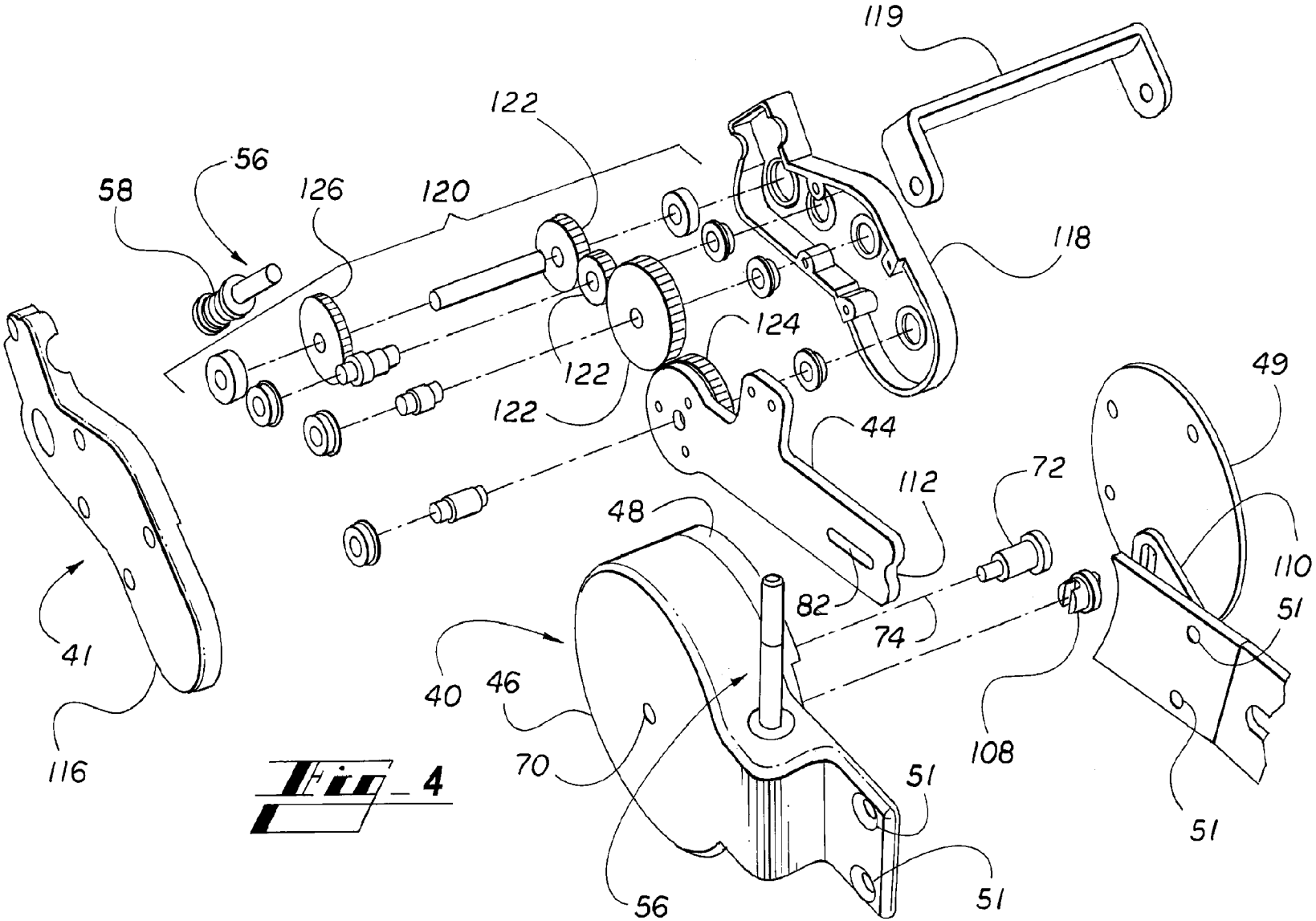
FIG. 4 is a perspective view of another portion of Vector 2 including the wrist drive unit of FIG. 2.

Wrist drive unit 40 provides a secondary static progressive force pathway. Second hinge housing 48 also defines bore 106 for receiving static lock actuator 108 (FIG. 4) controlled by lock actuator handle 110 (FIG. 4). As best illustrated in FIG. 2, housing cover plate 49 positions static lock actuator 108 within bore 106 and positions lock actuator handle 110 to the rest of wrist drive unit 40. Referring back to FIG. 3, limb support arm 44 also defines cutout 112 to provide space for static lock actuator 108 and lock actuator handle 110. Alternatively cutout 112 substantially prevents limb support arm 44 from interfering with the operation of static lock actuator 108 and lock actuator handle 110.

As shown in FIGS. 3 and 4, static lock actuator 108 provides a locking mechanism to lock second hinge housing 48 in relation to worm wheel 50. Worm wheel 50 includes at least one static lock pin 114 which can be located on either lateral side of worm wheel 50. In this illustrative embodiment, static lock pins 114 are located on both lateral sides of worm wheel 50. In this embodiment, at least one static lock pin 114 is located between the rest of worm wheel 50 and second hinge housing 48. In operation, at least a portion of static lock actuator 108 is located between worm wheel 50 and second hinge housing 48. Static lock actuator 108, as controlled by lock actuator handle 110, can lock on static lock pin 114. In a locked configuration, wrist drive unit 40 works under static progressive force. In this configuration, worm wheel 50 directly drives second hinge housing 48 though static lock pin 114 and static lock actuator 108 as an alternative static progressive force pathway.

Referring back to FIG. 2, hand drive unit 41 includes first and second clam shelled housings 116 and 118. Limb support arm 44 is coupled to first and second clam shelled housings 116 and 118 such that movement of limb support arm 44 causes corresponding movement of hand drive unit 41. First and second clam shelled housings 116 and 118 are configured to rotate in relation to rotational axis 74 as controlled by movement of second hinge housing 48.

As illustrated in FIG. 2, hand drive unit 41 is shown in a reduced, working configuration ready for operation. Hand drive unit 41 couples to drive bar 119. Drive bar 119 is coupled to leaf spring caterpillars 26. Drive bar 119 is driven by hand drive unit 41 which has a couple of optional drivers as described in greater detail below.

Now referring to FIG. 4, hand drive unit 41 provides a drive option which causes flexion and extension of digits 28 (either fingers or thumb of the patient). Hand drive unit 41 includes planetary gear system 120 including driven planetary gears 122. Hand drive unit 41 includes worm screw 56 which can be driven manually using manually actuatable member 62 (FIG. 2), such as knob 62 (FIG. 2), or mechanically using a motor (not shown). Worm screw 56 includes gear 58 which meshes with driver gear 126. Driver gear 126 is coupled to planetary gears 122 of planetary gear system 120. As second driver gear 126 is driven, second driver gear 126 drives planetary gears 122 of planetary gear system 120. Drive bar 119 is driven and rotated by one of the driven planetary gears 122 of planetary gear system 120. Drive bar 119 controls motion of leaf spring caterpillars 26. Rotation of drive bar 119 causes flexion and extension of digits 28 (either fingers or thumb of the patient). In this drive option, hand drive unit 41 transfers either dynamically loaded force and/or static progressive force (as provided by wrist drive unit 40) to the joint of the patient.

Rotation of limb support arm 44 causes raising and lowering of hand drive unit 41. When second hinge housing 48 rotates relative to first hinge housing 46, hand drive unit 41 rises and lowers based on the fixed connection of hand drive unit 41 to limb support arm 44. First driver gear 124 is fixed to limb support arm 44. First driver gear 124 is meshed with planetary gears 122 of planetary gear system 120. As planetary gears 122 of planetary gear system 120 are driven, first driver gear 124 doesn't turn. Hand drive unit 41 rotates about rotational axis 128 assisting in flexion and extension of hand 16 and/or digits 28 (either fingers or thumb of the patient).

In yet another alternative embodiment, hand drive unit 41 incorporates features of the present disclosure regarding wrist drive unit 40.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. A continuous passive motion device for use with a joint of a patient, the device comprising:

a first hinge housing, a second hinge housing coupled to the first hinge housing, the second hinge housing including at least one spring loading pin and a pin stop block, the second hinge housing configured to rotate about a rotational axis, the second hinge housing configured to rotate in relationship to the first hinge housing, a worm wheel located between the first hinge housing and the second hinge housing, the worm wheel including at least one spring loading pin, and at least one torsion spring located either between the first hinge housing and the worm wheel or between the worm wheel and the second hinge housing, the at least one torsion spring located adjacent to the worm wheel, the spring loading pin of the worm wheel configured to engage the at least one torsion spring, the at least one torsion spring configured to engage the spring loading pin and the pin stop block of the second hinge housing.

2. The device of claim 1 wherein the worm wheel includes a static lock pin, the static lock pin configured to interact with a static lock actuator as controlled by a lock actuator handle, wherein the second hinge housing defines a bore for receiving the static lock actuator.

3. The device of claim 1 wherein each of the first hinge housing, the at least one torsion spring, the worm wheel, and the second hinge housing define a rotational pin aperture, each of the rotational pin apertures in communication along the rotational axis, the rotational pin apertures configured to receive a rotational pin along the rotational axis, the rotational pin configured to couple together the first hinge housing, the at least one torsion spring, the worm wheel, and the second hinge housing.

4. The device of claim 1 further comprising a worm screw positioned to engage and drive the worm wheel, the worm screw configured to be driven manually or mechanically.

5. The device of claim 4, wherein the worm screw includes a gear and at least one bearing, the at least one bearing positioning the gear to engage and drive the worm wheel.

6. The device of claim 1 wherein the worm wheel defines at least one spring loading pin aperture, the spring loading pin aperture configured to receive the spring loading pin of the second hinge housing.

7. The device of claim 6 wherein a first portion of the spring loading pin of the second hinge housing is located between the worm wheel and the second hinge housing, wherein a second portion of the spring loading pin of the second hinge housing is located between the first hinge housing and the worm wheel, wherein the at least one torsion spring includes a first torsion spring and second torsion spring, the first torsion spring located between the worm wheel and the second hinge housing, the first torsion spring configured to engage the first portion of the spring loading pin of the second hinge housing, the second torsion spring located between the first hinge housing and the worm wheel, the second torsion spring configured to engage the second portion of the spring loading pin of the second hinge housing.

8. A continuous passive motion device for use with a joint of a patient, the device comprising:

a forearm frame configured to couple to the forearm of the patient, a wrist drive unit coupled to the forearm frame, the wrist drive unit including:

a first hinge housing coupled to the forearm frame, the first hinge housing defining a cavity, a rotational pin aperture, and a worm screw aperture, a second hinge housing coupled to the first hinge housing, the second hinge housing configured to rotate about a rotational axis, the second hinge housing configured to rotate in relationship to the first hinge housing, the second hinge housing including at least one spring loading pin and a pin stop block, the second hinge housing defining a rotational pin aperture and a bore for receiving a static lock actuator, the static lock actuator controlled by a lock actuator handle, a worm wheel located within the cavity of the first hinge housing, the worm wheel located between the first hinge housing and the second hinge housing, the worm wheel including at least one spring loading pin and a static lock pin, the static lock pin configured to interact with the static lock actuator as controlled by the lock actuator handle, the worm wheel defining at least one spring loading pin aperture and a rotational pin aperture, a worm screw positioned to engage the worm wheel, the worm screw including a gear located within the cavity, the worm screw including at least one bearing positioning the gear to engage the worm wheel, the worm screw configured to be driven manually or mechanically, at least one torsion spring located within the cavity of the first hinge housing, the at least one torsion spring located either between the first hinge housing and the worm wheel or between the worm wheel and the second hinge housing, the at least one torsion spring located adjacent to the worm wheel, the at least one torsion spring aligned along the rotational axis, the spring loading pin of the worm wheel configured to engage the at least one torsion spring, the at least one torsion spring configured to engage the spring loading pin and the pin stop block of the second hinge housing, the second hinge housing configured to cause flexion and extension of the joint of the patient.

9. The device of claim 8, further comprising:

a limb support arm coupled to the second hinge housing of the wrist drive unit, a hand drive unit coupled to the limb support arm, the hand drive unit configured to rotate about an axis substantially perpendicular to the longitudinal axis of the forearm, wrist, or hand of the patient causing flexion and extension of the wrist, hand, finger or thumb of the patient, and a hand plate coupled to the limb support arm, the hand plate configured for support by the forearm, wrist, or hand of the patient.

10. The device of claim 9, further comprising:

a leaf spring caterpillar coupled to the limb support arm, wherein the leaf spring caterpillar is malleable to adjust the range of motion of the hand, finger or thumb of the patient.

11. The device of claim 10, further comprising:

a glove configured to fit over the forearm, wrist, hand, finger or thumb of the patient, the glove fastened to the forearm frame or the hand plate by use of straps.

12. The device of claim 11, further comprising:

a finger plate coupled to the leaf spring caterpillar, the leaf spring caterpillar coupled to the distal end of the finger plate, the ventral side of the finger plate attached to the glove adjacent to a phalange of the finger or thumb of the patient, the finger plate approximating the length of the phalange.

* * * * *